US011547212B1

(12) United States Patent
Lirette-Brainard

(10) Patent No.: US 11,547,212 B1
(45) Date of Patent: Jan. 10, 2023

(54) ORTHOPEDIC LOUNGE CHAIR

(71) Applicant: Aimee M. Lirette-Brainard, North Port, FL (US)

(72) Inventor: Aimee M. Lirette-Brainard, North Port, FL (US)

( * ) Notice: Subject to any disclaimer, the term of this patent is extended or adjusted under 35 U.S.C. 154(b) by 0 days.

(21) Appl. No.: 17/857,830

(22) Filed: Jul. 5, 2022

Related U.S. Application Data

(60) Provisional application No. 63/218,019, filed on Jul. 2, 2021.

(51) Int. Cl.

| | |
|---|---|
| ***A47C 1/14*** | (2006.01) |
| ***A47C 7/02*** | (2006.01) |
| ***A47C 7/42*** | (2006.01) |
| ***A47C 7/46*** | (2006.01) |
| ***A47C 7/52*** | (2006.01) |
| ***A47C 1/026*** | (2006.01) |
| ***A47C 4/34*** | (2006.01) |

(Continued)

(52) U.S. Cl.
CPC ..... *A47C 1/143* (2013.01); *A47C 1/026* (2013.01); *A47C 1/14* (2013.01); *A47C 4/28* (2013.01); *A47C 4/32* (2013.01); *A47C 4/34* (2013.01); *A47C 4/44* (2013.01); *A47C 7/021* (2013.01); *A47C 7/0213* (2018.08); *A47C 7/383* (2013.01); *A47C 7/425* (2013.01); *A47C 7/46* (2013.01); *A47C 7/52* (2013.01); *A61G 15/007* (2013.01)

(58) Field of Classification Search
CPC ..... A47C 1/143; A47C 1/026; A47C 1/14; A47C 4/28; A47C 4/32; A47C 4/34; A47C 4/44; A47C 7/021; A47C 7/0213; A47C 7/383; A47C 7/425; A47C 7/46; A47C 7/52; A61G 15/007
USPC ..... 297/31, 129, 184.1, 184.11, 184.15, 297/188.08, 188.12, 219.1, 228.13, 284.1, 297/284.5, 900
See application file for complete search history.

(56) References Cited

U.S. PATENT DOCUMENTS 4,108,492 A * 8/1978 Kirby ..... A47C 7/467 297/284.6
4,252,371 A * 2/1981 Lehnen ..... A47C 5/10 297/27

(Continued)

*Primary Examiner* — Robert Canfield
(74) *Attorney, Agent, or Firm* — The Concept Law Group, P.A.; Scott D. Smiley; Scott M. Garrett

(57) ABSTRACT

An orthopedic lounge chair includes a substantially flat support surface that has a length, a width, a front side, and a back side and defines a back support section, a seat section foldably joined to the back support section at a first fold junction, and a leg support section foldably joined to the seat section at a second fold junction, a first bolster support coupled to and rising away from the front side of the back support section, the first bolster support extending longitudinally at least a majority of the width of the support surface, a second bolster support coupled to and rising away from the front side of the seat support section, the second bolster support extending longitudinally at least a majority of the width of the support surface, and a third bolster support coupled to and rising away from the front side of the leg support section, the third bolster support extending longitudinally a majority of the width of the support surface, wherein the first bolster, the second bolster, and the third bolster are not located on the first fold junction or the second fold junction of the lounge chair.

17 Claims, 9 Drawing Sheets

(51) Int. Cl.

| | |
|---|---|
| ***A47C 4/28*** | (2006.01) |
| ***A47C 4/44*** | (2006.01) |
| ***A47C 4/32*** | (2006.01) |
| ***A61G 15/00*** | (2006.01) |
| ***A47C 7/38*** | (2006.01) |

(56) References Cited

U.S. PATENT DOCUMENTS 4,711,492 A * 12/1987 Asbjornsen ..... A47C 7/405 297/284.7
4,941,222 A * 7/1990 Prager ..... A47C 1/143 D6/601
5,237,713 A * 8/1993 Prager ..... A47C 7/506 5/636
5,246,265 A * 9/1993 Nagan ..... A47C 17/70 297/54
5,326,152 A * 7/1994 Baron ..... A47C 31/11 297/229
D349,625 S * 8/1994 daPalma ..... D6/596
D389,362 S * 1/1998 Boulatian ..... 5/419
5,727,841 A * 3/1998 Morley ..... A47C 1/143 297/188.06
5,729,846 A * 3/1998 Sullivan ..... A47G 9/062 5/923
5,824,013 A * 10/1998 Allen ..... A61F 5/01 606/240
D406,486 S * 3/1999 Ogilvie ..... D6/601
6,059,365 A * 5/2000 Diamond ..... A47C 1/143 5/652.1
6,086,152 A * 7/2000 Zeller ..... A47C 7/425 297/DIG. 6
6,126,237 A * 10/2000 Ritterhouse ..... A47C 7/383 297/410
6,626,491 B1 * 9/2003 Biome ..... A47C 1/143 297/229
6,669,300 B1 * 12/2003 Lee ..... B60N 2/882 297/397
7,175,231 B2 * 2/2007 Gallo ..... A47C 1/143 297/228.11
8,668,268 B1 * 3/2014 Cormack ..... A47C 1/143 297/354.13
9,161,632 B1 * 10/2015 Tomaini ..... A47C 7/52
9,332,858 B1 * 5/2016 Chiang ..... A47C 7/62
9,468,301 B2 * 10/2016 Rivera ..... A47C 7/18
9,801,366 B2 * 10/2017 Ruybal ..... A47C 4/286
9,867,409 B1 * 1/2018 Mróz ..... A47C 31/11
11,141,009 B1 * 10/2021 Rane ..... A47G 9/10
2003/0011219 A1 * 1/2003 Chun-Yueh ..... A47C 1/143 297/51
2003/0209935 A1 * 11/2003 Legal ..... A47C 31/023 297/31
2004/0095006 A1 * 5/2004 Chen ..... A47C 4/286 297/284.6
2006/0255634 A1 * 11/2006 Gallo ..... A47C 1/143 297/220
2010/0001565 A1 * 1/2010 Gray ..... A47C 7/624 297/229
2011/0008100 A1 * 1/2011 Tseng ..... A47C 4/44 403/104
2012/0098310 A1 * 4/2012 Bryer ..... A47C 7/0213 297/284.4
2015/0366357 A1 * 12/2015 Nelson ..... A47C 5/10 224/155
2016/0166067 A1 * 6/2016 Tanaka ..... A47C 7/543 297/411.3
2019/0045932 A1 * 2/2019 Turner ..... A61H 19/44
2022/0175140 A1 * 6/2022 Lee ..... A47C 1/026

* cited by examiner

ORTHOPEDIC LOUNGE CHAIR

CROSS-REFERENCE TO RELATED APPLICATION

This application claims priority to U.S. Provisional Patent Application No. 63/218,019 filed Jul. 2, 2021, the entirety of which is incorporated by reference.

FIELD OF THE INVENTION

The present invention relates generally to lounge chairs, and, more particularly, relates to lounge chairs with specifically placed bolster supports.

BACKGROUND OF THE INVENTION

Most conventional lounge chairs are designed to enable a user to lie on his or her back in the supine (face up) position or prone (face down). Such lounge chairs are tri-fold lounge chairs that typically have a seatback that can be tilted up so that, when the user is in the supine position, the user's back is inclined relative to their legs, which generally extend straight out in front of the user's torso. These chairs, however, while supporting the entire human body, are not able to provide focused support on key areas of the body. As a result, individuals that have back (lumbar) pain or neck (cervical spine) pain, generally referred to as significant chiropractic problems, are not able to comfortably sit or lie down in a conventional lounge chair, which provides only a low level of support throughout.

Therefore, a need exists to overcome the problems with the prior art as discussed above.

SUMMARY OF THE INVENTION

The invention provides an orthopedic lounge chair that overcomes the hereinabove-mentioned disadvantages of the heretofore-known devices and methods of this general type and that includes at least three bolster supports, one bolster support being for the lumbar region, one bolster support being for the knee region, and one bolster support being for the ankle region, with an optional bolster support also for the neck region.

The additional firmness provided by the inventive bolster supports disclosed herein ensures the user receives extra support in particular areas of their body and alleviates or avoids pain for the user. The inventive bolsters, which provide extra support compared to a conventional lounge chair, supports the back, knee, ankle, and/or neck of the user. The bolster supports of the herein disclosed orthopedic lounge chair enhance user comfort and relaxation by supporting proper body alignment, thus providing both therapeutic and preventive health benefits. The instant orthopedic lounge chairs enable individuals having chiropractic problems to return to the comfort of relaxing in a wide variety of locations including by a pool, at the beach, or in the peace and tranquility of their own backyard.

Disclosed aspects include a tri-fold orthopedic lounge chair that includes an outer frame having a structural material defining a width and a length of the orthopedic lounge chair, providing an outer boundary for a back support section, a seat section, and a leg support section. In one embodiment, a sling material spans the width and the length of the orthopedic lounge chair. There can be support legs that include a hinge between the back support section and the seat section, a hinge between the seat section and the leg support section. In one embodiment, a hinge is 12 inches from the top of the chair, at the adjoining back-seat area (44.5 inches from the top), and at the adjoining leg support sections (66 inches from the top). The total chair length, in one embodiment, is 84.5 inches, but the invention is not so limited and can be other lengths and dimensions. The orthopedic lounge chair, according to an embodiment of the present invention, also includes a plurality of bolster supports, which each may be releasably attached to the sling material creating a lumbar bolster along the back support section, a knee bolster, and an ankle bolster positioned along the leg support section.

There can also be an optional neck bolster to support the neck and/or a rollout towel. The neck bolster can be a towel rolled into a tubular shape. The non-towel bolster supports can generally be removed and stored within a pouch on the backside of the sling material. Each of the bolster supports (the lumbar, knee, ankle, and neck bolsters) are generally attached to their corresponding pouch by two elastic straps. Elastic straps can be sewn to the pouch on one end and the strap can be secured to the back of the bolster by a fastener, such as a hook and loop fastener, e.g., VELCRO, patch affixed to the other end of the strap and the underside of the bolster. The attached straps provide some assurance the bolster is not lost and remains in the approximate position of its intended placement. The length of the strap allows a bolster to be pulled through from the (underside) pouch and rest on its front placement. Straps 902, 904 will generally be about six-inches in length to enable adjustment to enable positioning the bolster supports in the user's preferred position. (See FIG. 9 and description below).

With the foregoing and other objects in view, there is provided, in accordance with the invention, an orthopedic lounge chair that includes a substantially flat support surface having a length, a width, a front side, and a back side and defining a back support section, a seat section foldably joined to the back support section at a first fold junction, and a leg support section foldably joined to the seat section at a second fold junction. A first bolster support is coupled to and rises away from the front side of the back support section, the first bolster support extending longitudinally at least a majority of the width of the support surface. A second bolster support is coupled to and rises away from the front side of the seat support section, the second bolster support extending longitudinally at least a majority of the width of the support surface. A third bolster support is coupled to and rises away from the front side of the leg support section, the third bolster support extending longitudinally a majority of the width of the support surface. The first bolster, the second bolster, and the third bolster are not located on the first fold junction or the second fold junction of the lounge chair. A towel is provided on the back side of the substantially flat support surface, the surface having a slot for the towel to pass from the back side to the front side of the support surface. The towel can be used as a fourth bolster when manually rolled into a tubular configuration and provided on the front side of the support surface.

In accordance with another feature, an embodiment of the present invention includes the first bolster support, the second bolster support, and the third bolster support rising above the substantially flat support surface at least 2.5 inches, but it can rise more than 2.5 inches, e.g., 3.5 inches.

In accordance with a further feature of the present invention, the first bolster support is located on the support surface in the area of a user's lumbar, the second bolster support is located on the support surface in the area of a user's knee; and the third bolster support is located on the support surface in the area of a user's ankle.

In accordance with an additional feature of the present invention, at least one bolster storage pocket is located on the back side of the substantially flat support surface, the at least one bolster storage pocket being accessible from the front side of the substantially flat support surface, through an aperture in the substantially flat support surface.

In accordance with one more feature of the present invention, the first bolster support, the second bolster support, and the third bolster support each have a firmness that prevents a compression of more than 50% when a human body is supported on the support surface.

In accordance with an additional feature of the present invention, a towel spool disposed on the back side of the support surface.

In accordance with another feature of the present invention, a towel is disposed on the towel spool, the towel being retractable and extendable on the towel spool and long enough to cover at least a majority of the length of the front side of the support surface.

In accordance with an added feature of the present invention, a frame defines and supports the back support section, seat section, and leg support section, the frame having at least two fold portions, where a first portion of the frame folds onto a second portion of the frame.

In accordance with yet another feature of the present invention, at least two support legs are foldably coupled to the frame.

Although the invention is illustrated and described herein as embodied in an orthopedic lounge chair, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the orthopedic lounge chair or object being referred to. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

FIG. 2 also shows a towel on a spool positioned on a back of a top side of the orthopedic lounge chair, the towel being shown extending to the distal end of the leg support section of the chair.

DETAILED DESCRIPTION

Figure 1:
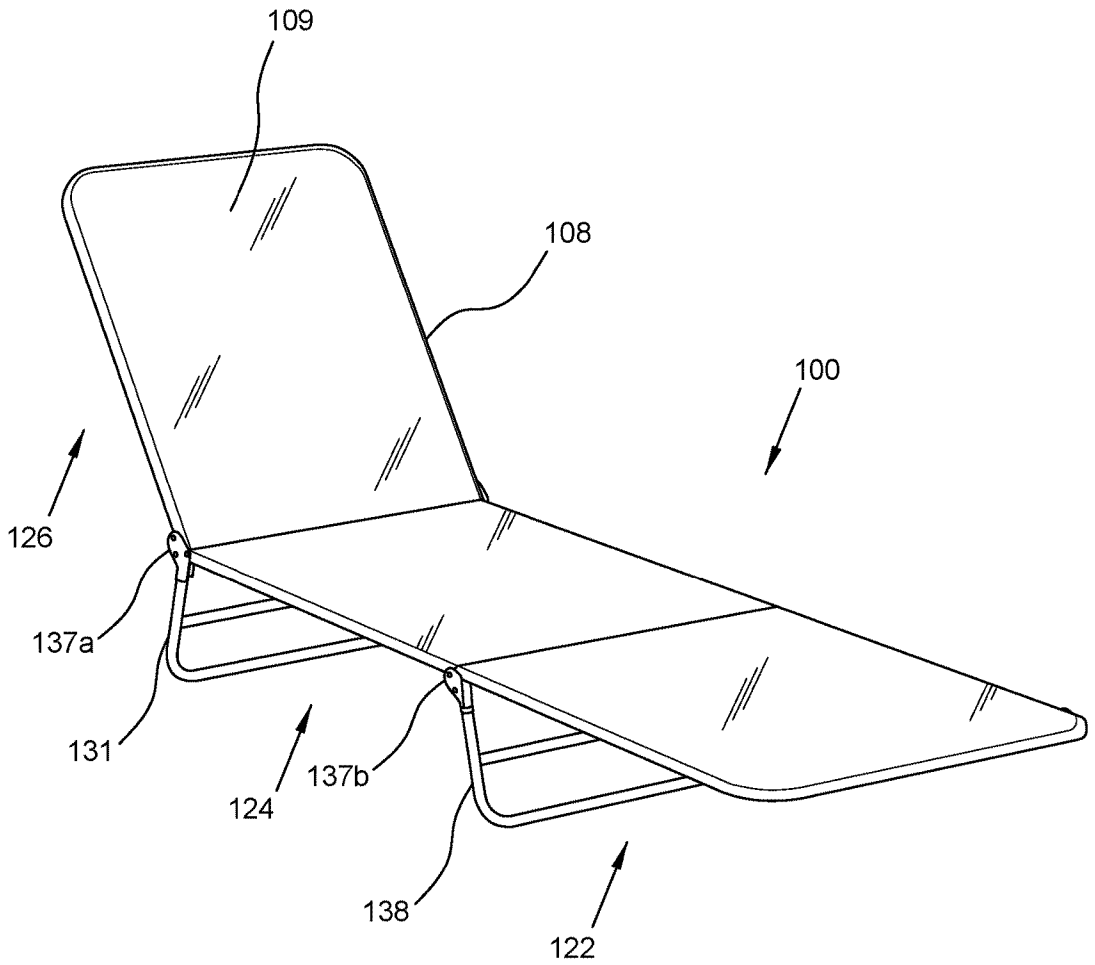
FIG. 1 is a perspective top view depiction of an exemplary orthopedic lounge chair having an outer frame with a structural material defining a width and a length of the orthopedic lounge chair providing an outer boundary, in accordance with an embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient orthopedic lounge chair. Embodiments of the invention provide a chair with specifically located support members aligned with parts of the user's body that are intended to result in comfort and orthopedic support. In addition, embodiments of the invention provide a chair with a towel holder and features that make the chair easy to transport.

Referring now to FIG. 1, one embodiment of the present invention is shown in a perspective top-side view. FIG. 1 shows several advantageous features of the present invention, but, as will be described below, the invention can be provided in several shapes, sizes, combinations of features and components, and varying numbers and functions of the components. The first example of an orthopedic lounge chair 100, as shown in FIG. 1, includes a frame 108 comprising a structural material defining a width and a length of the orthopedic lounge chair by providing an outer boundary. A support surface 109 made, in one embodiment, of a sling material, spans the width and the length of the frame 108. The orthopedic lounge chair 100 has three sections, including a back support section 126, a seat section 124, and a leg support section 122. There is a support leg 131 attached to a hinge 137*a* that is positioned between the back support section 126 and the seat section 124 and a support leg 138 attached to a hinge 137*b* that is positioned between the seat section 124 and leg support section 122. When the orthopedic lounge chair 100 is in a fully open configuration as shown, an individual can sit upon the seat section 124, lean against the back support section 126, and have his/her feet resting upon the leg support section 122.

Each support leg 131, 138 of the orthopedic lounge chair 100 can fold in as well to secure a compact design. Support leg 131 will fold against the underside of the back of the seat section 124. Support leg 138 can also fold either against the seat section 124 or against the leg support section 122. Typical embodiments only allow the support legs 131, 138 to fold in one direction, but the invention is not so limited. Each fold allows for a compact and functional design. In accordance with one embodiment of the present invention, the chair 100 has an overall length of about 84.5 inches and a width of about 25 inches. These exemplary dimensions are slightly larger than common industry-used frames, but are still within limits of standard dimensions (and were tested with similarly constructed prototype for comfort and ease of transport with those of varying age, size and strength), however, other dimensions can be used as well. Selected measurements have been assessed for overall impact on chair construction and function with the conclusion that small adjustments for frame material size will not impact quality, ease of use, comfort, or functionality of chair attributes. Support legs 131, 138, in one embodiment, have a height of 18.5 inches. The 18.5-inch height on the leg support section 122 allows the user to adjust hinge 137*b* to a 90° angle and form a standard upright chair position.

Figure 2:
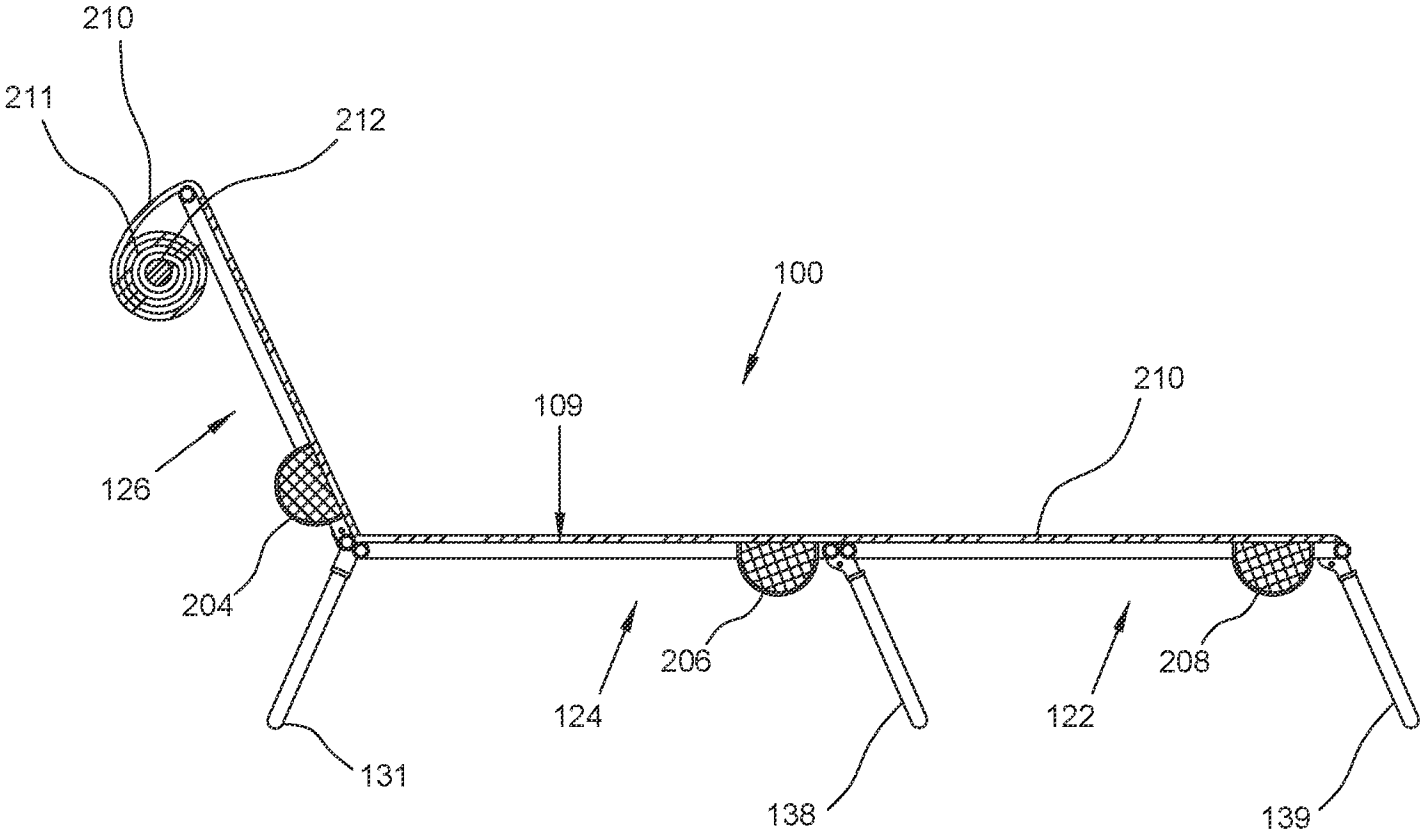
FIG. 2 is an elevational side view depiction of the orthopedic lounge chair of FIG. 1, illustrating a plurality of bolster supports, including a lumbar region bolster, a knee bolster and an ankle bolster, in a stowed position, according to an exemplary embodiment of the present invention.
Figure 4:
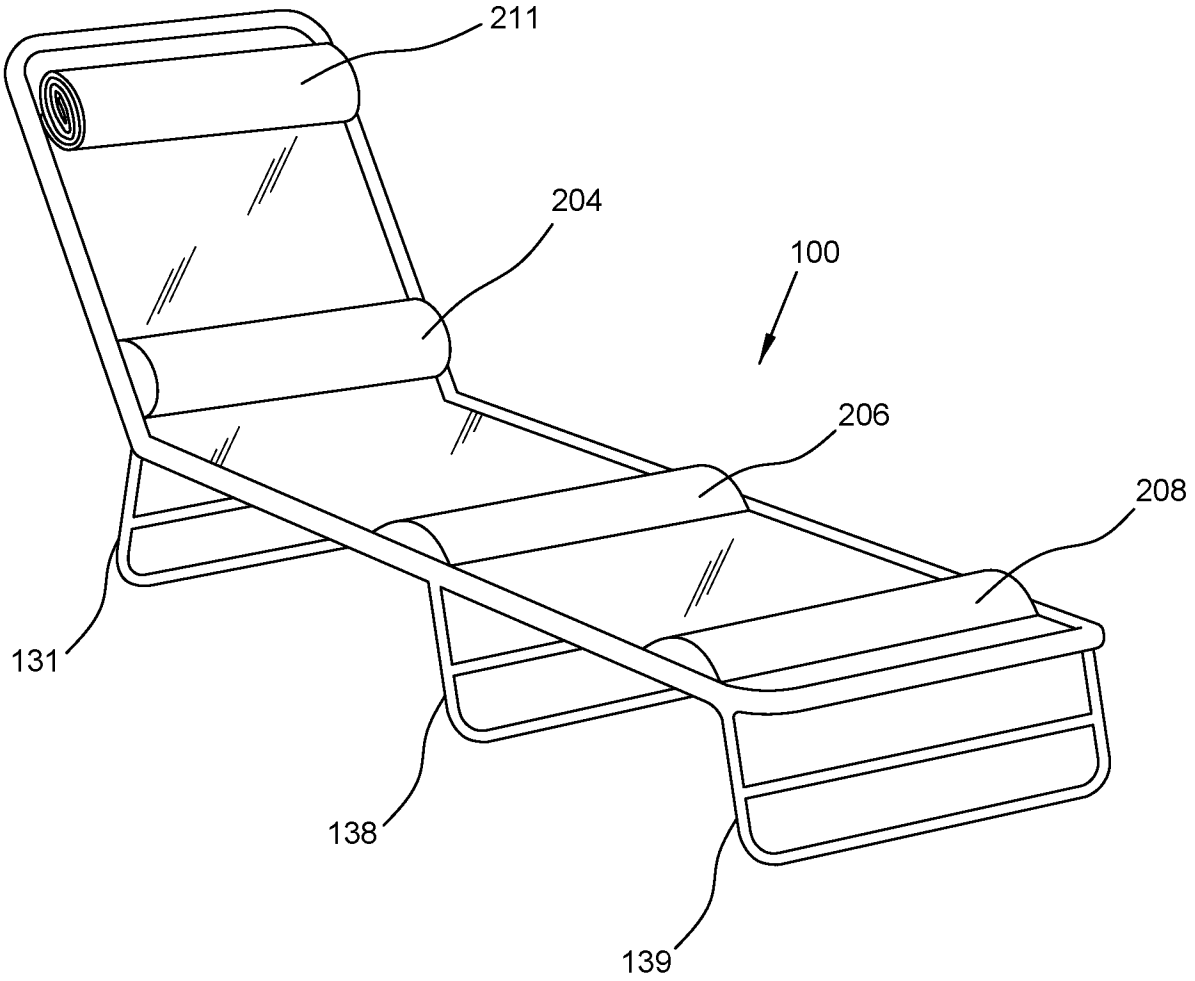
FIG. 4 is a perspective top view depiction of the exemplary orthopedic lounge chair of FIG. 2 with the four bolsters deployed from their storage pouches and secured to a top surface of the sling material, according to an embodiment of the present invention.

FIG. 2 is an elevational side view depiction of an exemplary orthopedic lounge chair 100 that shows bolster supports 204 (lumbar), 206 (knee), and 208 (ankle). As described above, the bolster supports 204, 206, 208 function to support proper body alignment in both the supine (face-up) and the prone (face-down) positions when they are deployed. In this view, however, each of the bolster supports 204, 206, 208 are in a non-deployed position, i.e., they are in their storage position under the support surface 201 of the lounge chair 100. The orthopedic lounge chair 100 can be enabled by the bolster supports 204, 206, and 208 to support (90°) seated (bi-fold chair position) to (180°) horizontal (trifold) position, and all angles of recline as facilitated by the orthopedic lounge chair 100. Once deployed, as is shown in FIG. 4, the bolsters 204, 206, and 208 provide an upward support force to a user laying on the support surface 109.

The term "bolster support," as used herein, is typically an elongated article, such as a tubular pillow, for example, that is filled with material such as cotton, down, fiber, or the like, for support to render it with a select amount of firmness. The bolster supports 204, 206, and 208 provide extra support to selected areas of the body of the user. The bolster supports 204, 206, and 208 may include machine-washable covers made of a soft fabric. The bolster supports 204, 206, and 208 are relatively firm, with reference to how much (the distance) one of the bolster supports 204, 206, and 208 will compress whenever a given weight is applied to it.

Standard commercially available sized, e.g., 18 inches× 5.5 inches×3.5 inches, half-moon shaped bolsters can be used as the bolster supports 204, 206, and 208 for comfort and medically supported therapeutic benefit. The invention, however, is in no way limited to these exemplary dimensions. Bolsters are commercially available in varying sizes and shapes, so that consumer preference or individual therapeutic benefit may be a viable option for bolster selection. The material for the bolster supports can include a polyester fiber or other types of fill with a suitable outside material (e.g., outer covering of pillow). For example, a water and mildew resistant polyester canvas and polyurethane backed material). Another example is a material marketed as SUNBRELLA or TEXTILENE. SUNBRELLA is an all-weather woven acrylic fabric-selected for its comfort, durability, stain resistance, UV protection, water repellence and fade resistance capability and TEXTILINE is made from polyester yarns that are individually coated with PVC, woven and heat set. Other suitable materials may be used as well.

Optionally the bolster supports can comprise an inflatable or "pump" action bolster, crank and gear raising bolster, automated rising bolsters, or other bolsters that can be manually moved into position. Such bolster supports can be similar to the lumbar support found in some motor vehicles.

The material for the outer frame 108 can be, for example, polyvinyl chloride (PVC) pipe, recycled plastic, all-weather steel, or heavy-duty aluminum. Material variance may be considered for size, strength, durability and (marketed) environment for use. The support surface 109 can be Vinyl-coated PHIFERTEX or PVC-coated TESLIN, materials both commonly used with PVC outdoor furniture for their sustainability in diverse outdoor conditions, for stretching across the width of the orthopedic lounge chair 100 from one side of the outer frame 108 to an opposite side of the outer frame 108. Other suitable materials may also be used.

Figure 8:
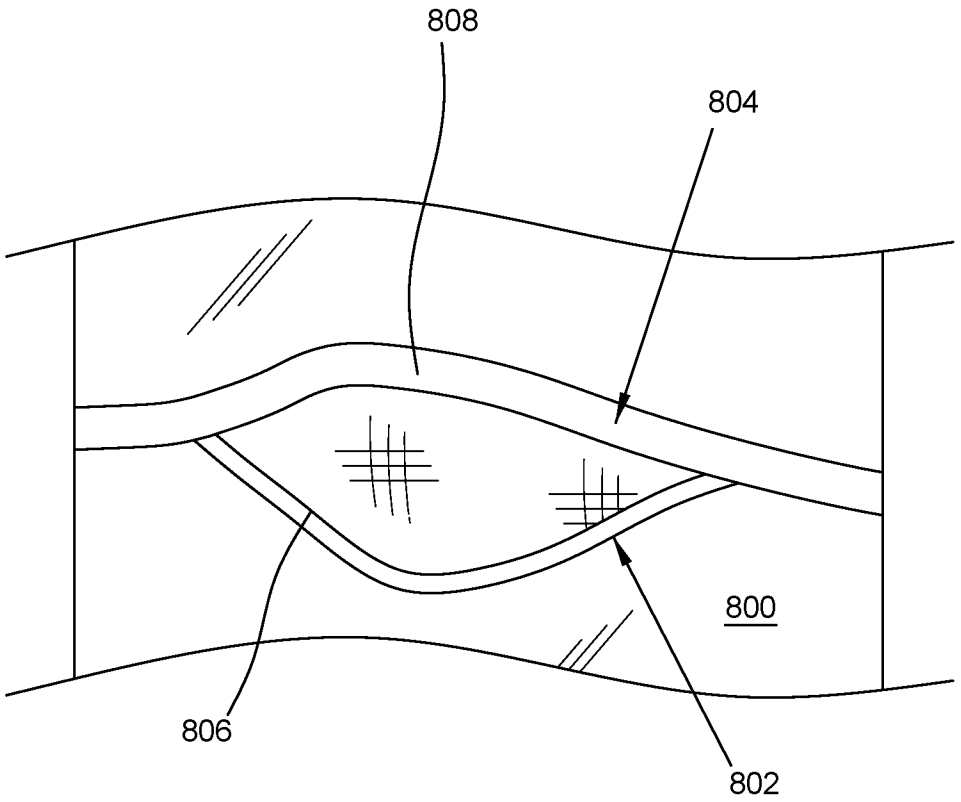
FIG. 8 is a depiction of a bolster storage pocket in an open position, in accordance with an embodiment of the present invention.

As shown in FIG. 8, the support surface 109 can be split and varied in size to include a back "pocket" or pockets 800 that can store the bolster supports 204, 206, and 208. The support surface 109 can be constructed with overlapping portions 802, 804 to allow heavy duty strips 806, 808, e.g., hook and loop fastener material, to align with opposing pieces of the material of the outer frame 108 creating the (unbolstered) flat chair surface. Heavy duty plastic zippers with an overlapping flap for comfort or a simple overlapping flap design can be substituted for the hook and loop fastener material.

The bolster pockets 800 can be attached on the underside of the support surface 109 generally according to standard, industry-measured, areas for back (lumbar), knee and ankle of similar trifold chaise lounge chairs. Regarding example positioning, the bolster pockets can be positioned, from the top-most part of the chair 100: approximately 12 inches (neck-if using a bolster and not the towel option), approximately 29 inches (lumbar), approximately 60 inches (knee), and approximately 78 inches (ankle). Measurements for locating the bolster pockets can be obtained from a commercially sold chaise lounge chair with an end-to-end length of approximately 84.5 inches.

Also shown in FIG. 2 is a set of towels 210, 211, which are held on a spool 212 and positioned on a back side of the orthopedic lounge chair 100. One of the towels, 210, can roll out to cover the lounge chair 100, extending to the distal end of the leg support section 122. The other towel 211 can be manually rolled and used as an additional bolster or detached and used as a drying off towel—or not used at all. The respective bolster supports 204, 206, and 208 can each be releasably attached to the fabric material that is attached to the outer frame 108 by straps 902 and 904 (shown in FIG. 9) or the like. On the opposing end of each elastic strap 902, 904 can be a hook and loop piece that connects to an opposing hook and loop patch that has been affixed to the (flat) backside of each bolster support. The two elastic straps 902 and 904 allow for a moveable and removeable bolster support.

Bolster supports generally do not span the entire width of the orthopedic lounge chair, generally being approximately 7 inches less than the width of the chair 100. This difference in width is to accommodate the legs of the chair when the chair is in its folded, storage and transport, position. Bolster supports 204, 206, and 208 can be equivalent to most standard commercial-size, D-shape bolsters with indicated body placement and of similar use. Bolster supports 204, 206, and 208 can be easily interchanged with similar commercially sold bolsters. Additionally, a slightly shorter bolster support provides easy release and return of bolster supports to their corresponding pouch.

The bolster supports 204, 206, and 208 being "moveable" gives the user the option to adjust the placement of the bolster to provide an extra level of comfort. The ability of the bolster supports to be "removeable" enables the user the option to interchange any of the other bolster supports that are provided with the orthopedic lounge chair, or exchange/replace any of the bolster supports for another commercially purchased bolster if desired.

The towel 210 may be approximately 86 inches in length. Two straps (e.g., 25 inches in length) can be attached underside of the orthopedic lounge chair 100 (and under the spool 212 holding the towels 210, 211) oriented to run parallel to each other, such as spaced 5½ inches from the opposing sides of the orthopedic lounge chair and each being about 1½ inches in width to come up and around the towel 210 once rolled and attach to a top bar of the orthopedic lounge chair 100 to secure for storage or ease of transport. In a preferred embodiment, the straps come around the towels 210, 211 and pass through a hinged opening 12 inches from the top of the lounge chair 100 and attach securely to a fastener, e.g., VELCRO.

When ready to use, the user can simply detach the straps holding the towels 210, 211 on the spool 212 and then pull one of the towels 210, 211 over the top of the orthopedic lounge chair 100 (and bolster supports 204, 206, and 208, if desired). The spool 212 enables the towel 210 to roll out easily over the orthopedic lounge chair 100 to a desired length. The user can easily roll the towel 210 back up to the spool 212 and attach it with the straps when done using it. The other end of the towel 210 can be attached to the spool 212 on the inside with clips, hook-and-loop fasteners, or the like for easy removal. The user can use one of the towels 210, 211 to wrap around their body, lay on the sand, wash, or replace. The other one of the towels 210, 211 can function as an additional bolster for the neck. In other words, one of the towels 210, 211 is an elongated towel sized sufficiently to allow the user to cover the orthopedic lounge chair 100 and the user can roll or fold the other of the towels 210, 211, which can be provided in a varied size (thickness) and shape (rolled or flat folded pillow) for personalized neck support.

Figure 3:
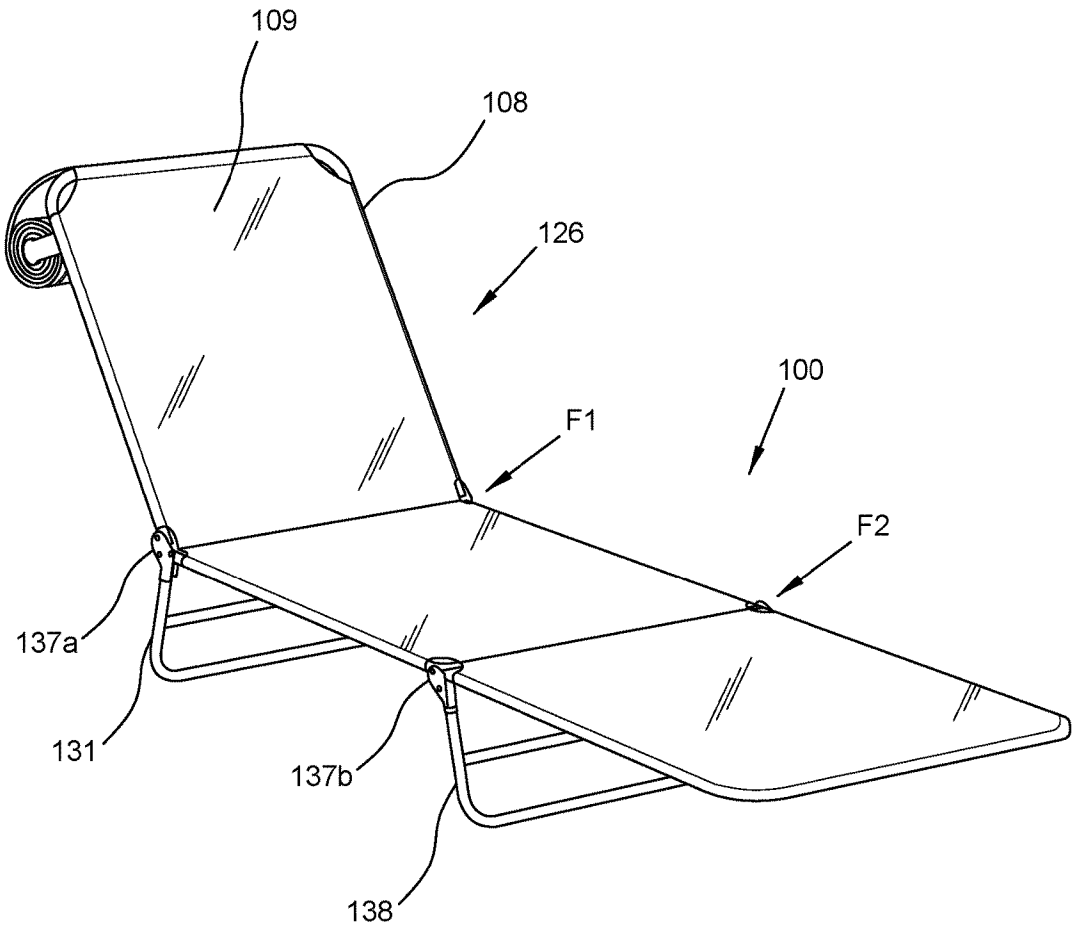
FIG. 3 is a perspective top view depiction of an exemplary orthopedic lounge chair showing three folding points that provide a tri-fold feature, according to an exemplary aspect of the present invention. This folding feature enables the user to switch between an open configuration, so it is suitable for sitting in or laying on, and a folded configuration, best suited for transporting.

FIG. 3 is a perspective top view depiction of the exemplary orthopedic lounge chair 100 showing the folding aspect that provides tri-fold positioning. FIG. 3 shows two fold lines F1 and F2 and shows the direction the legs 131, 138, and 139 fold. The orthopedic lounge chair 100 enabled by the hinges 137*a*, and 137*b* that fold together at folds F1 and F2 provide ease of transport and additional functionality. Fold F1 moves upwards towards the chair base (chair center)

in varying degrees, and flat against and atop the chair base. Fold F2 folds down in varying degrees towards the underside of the chair base and ultimately lies flat against the chair base in opposing position to the chair back. This folding feature enables the user to switch between an open configuration, so it is suitable for sitting in, and a folded configuration suited for transporting the orthopedic lounge chair 100. The user can fold the chair from a 90° sitting position, frame legs extended for lounge position, flat 180° laying down position, and flat on the ground with an upright back and the leg sections extended.

FIG. 4 is a perspective top view depiction of the exemplary orthopedic lounge chair 100 with the bolster supports 204, 206, and 208 deployed on top of the support surface 109, according to an example aspect. Although FIG. 4 shows four bolster supports 204, 206, and 208 deployed from their storage area 800 (show in FIG. 8), any number of bolster supports 204, 206, and 208 can be used. In accordance with one embodiment, the bolster supports 204, 206, and 208 are each D-shaped, i.e., flat bottom and tubular top shape. An exemplary dimension is 18 inches long and 5.5 inches in diameter. When a user lays on the orthopedic lounge chair 100 with one or more of the bolster supports 204, 206, and 208 deployed, specific support is applied to an area(s) of the user's body, thereby providing therapeutic support, relief, and benefits.

Figure 5:
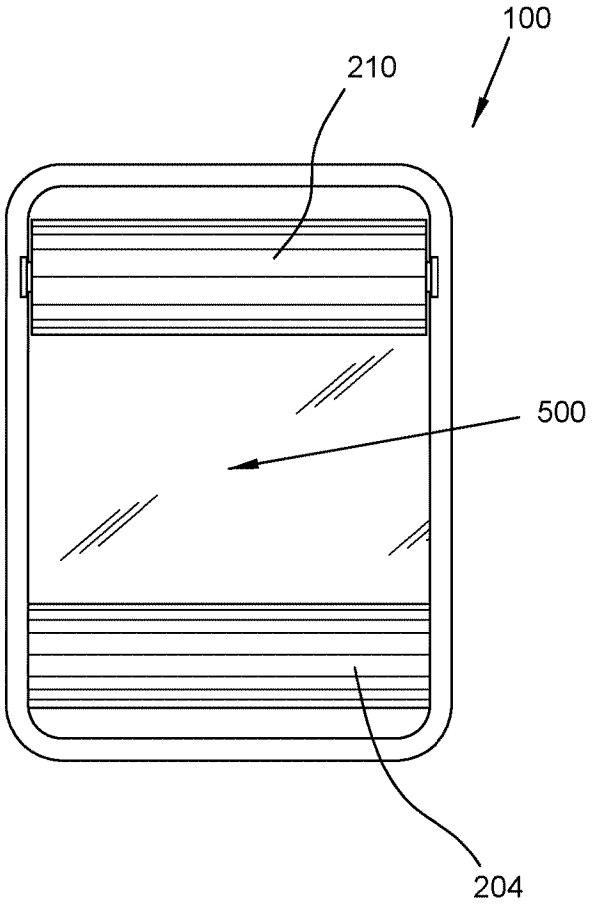
FIG. 5 is an elevational view of the back side of an exemplary orthopedic lounge chair when in the folded position and shows the towel and lumbar bolster placement in a back side pouch for a backpack carrying position, in accordance with an embodiment of the present invention.

FIG. 5 is a depiction of the back side 500 of an exemplary orthopedic lounge chair 100 when in the folded position. FIG. 5 depicts the towel 210 and lumbar bolster support 204 in a stowed placement on the back side 500 in a backpack carrying position. The chair 100 can be inserted into a pouch in this position for easy transport.

Figure 6:
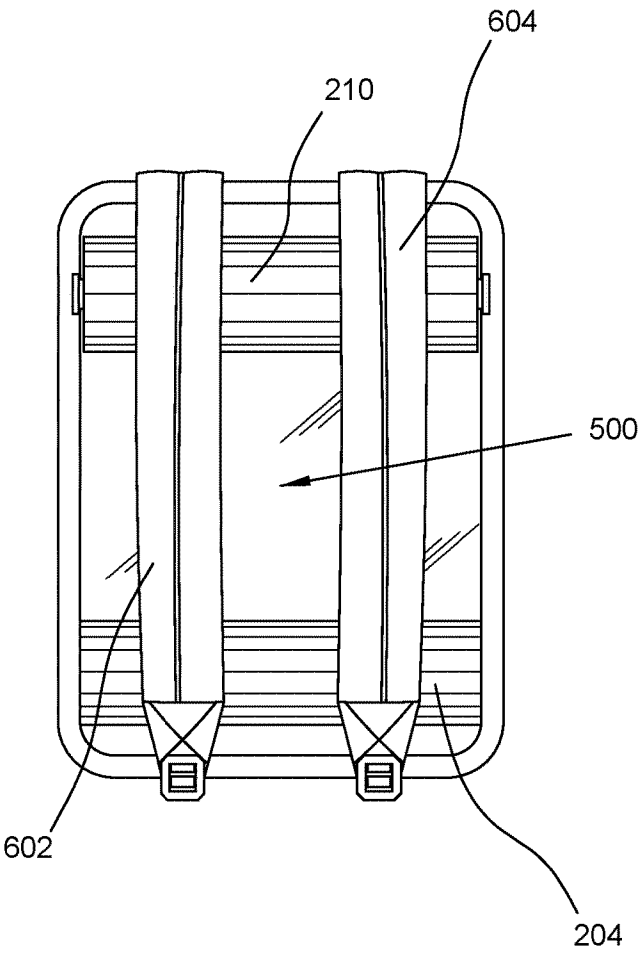
FIG. 6 is an elevational view of an exemplary orthopedic lounge chair with backpack straps, where the backside of the chair is able to rest on the user's back, in accordance with an embodiment of the present invention.

FIG. 6 is a depiction of the exemplary orthopedic lounge chair 100 configured with backpack straps 602 and 604 where the backside 500 of the orthopedic lounge chair 100 can reside on the user's back in a standard backpack-carrying method. Once the chair 100 is folded together, straps 602 and 604 are pulled to the backpack position for easy transport. These straps 602 and 604 are adjustable in length. In this position, the chair can be easily carried in "backpack-like" function. A pocketed (see FIG. 8) bolster support in the lumbar position and "towel bolster support" will lay against the user's neck offering comfort and support in this position as well as assuring the chiropractic lounge chair is in an appropriate position for ease of carrying.

Figure 7:
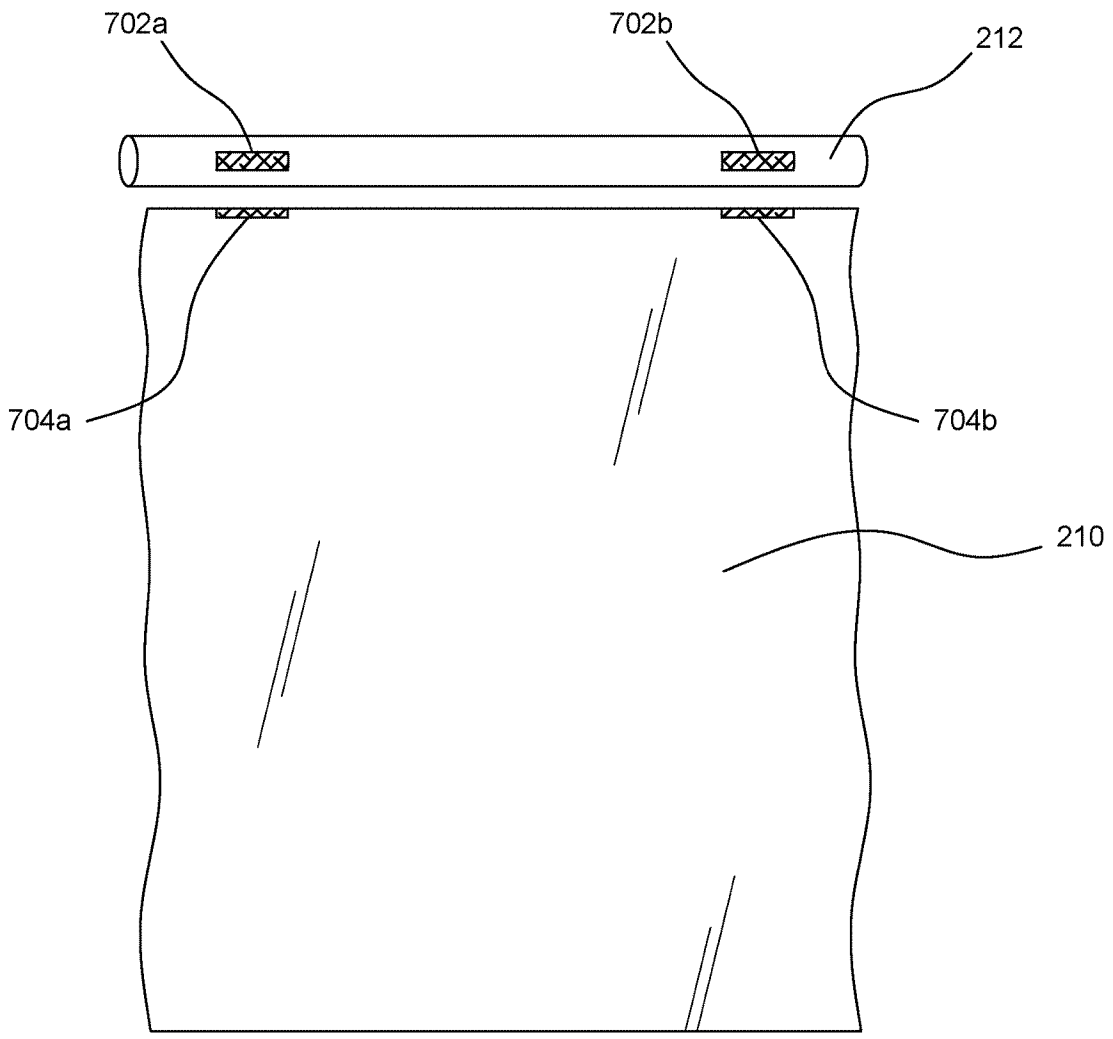
FIG. 7 is a depiction of the towel shown in FIGS. 6 and 7 extended by the user, where the towel is shown attached to a towel spool of the orthopedic lounge chair, in accordance with an embodiment of the present invention.

FIG. 7 is a depiction of the towel 210 shown in FIG. 6 extended by the user, where the towel is shown attached to the towel spool 212 of the orthopedic lounge chair by VELCRO. Specifically, FIG. 7 shows two VELCRO hook portions 702*a* and 702*b* on the spool 212 and two VELCRO loop portions 704*a* and 704*b* on the towel 210. The hook and loop portions removably attach to one another to secure the towel 210 to the spool 212.

As shown in FIG. 8, the bolster supports 204, 206, and 208, when not in use in their support role, can be stored in pockets 800 (sized to hold the bolster supports within) on the underside of orthopedic lounge chair 100. The access opening 802, 804 can be on the top side of the chair or the bottom side. To use the bolster supports 204, 206, and 208, in one arrangement, a user can open an enclosed-fold pocket 800 on the front side of the orthopedic lounge chair and manually pull the respective bolsters 204, 206, and 208 from their attached pocket 800. Thus, the user has the option to selectively use any one or all of the bolster supports 204, 206, and 208 or none.

Figure 9:
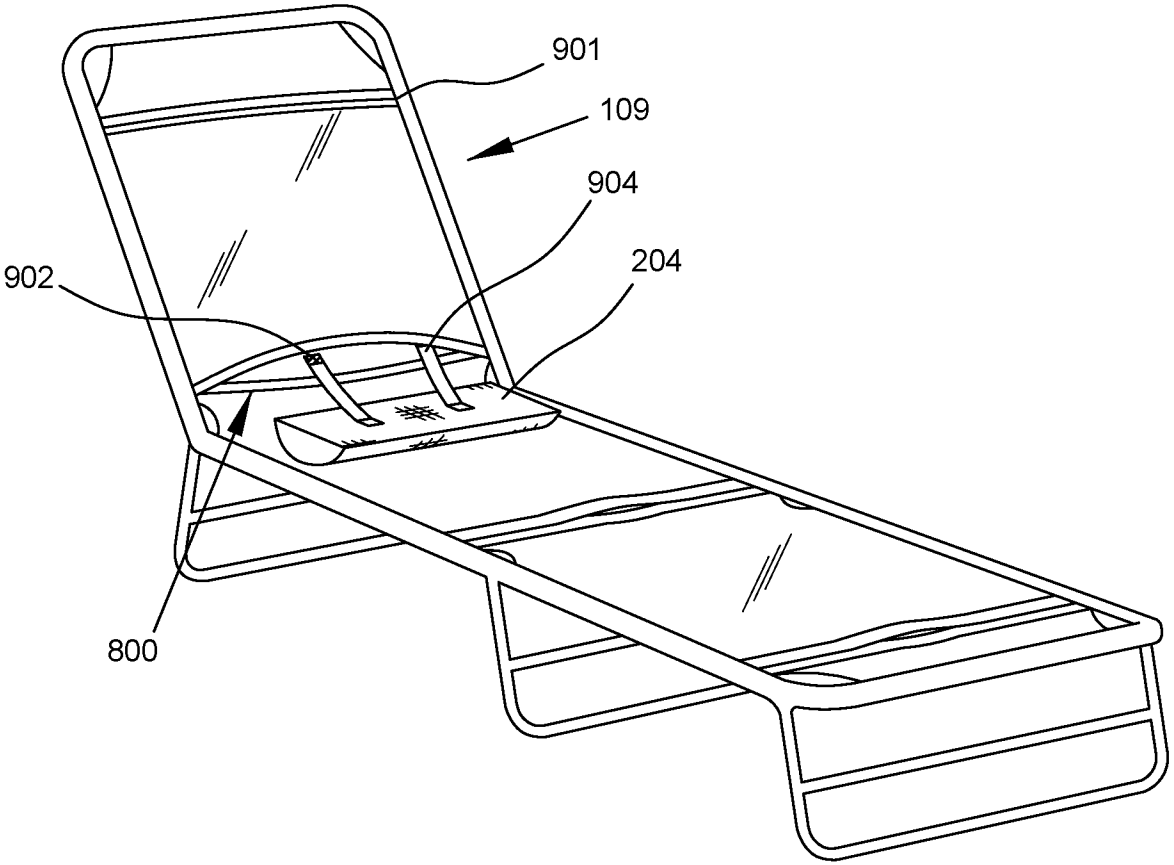
FIG. 9 is a perspective top view depiction of the exemplary orthopedic lounge chair of FIG. 2 with back support bolsters deployed from its storage pouch and secured with two straps, in accordance with an embodiment of the present invention.

FIG. 9 shows that a bolster support, e.g., support 204 can be secured to its pocket 800 with two straps 902, 904 on the bolster support's (flat) underside (approximately 10 inches in length). The straps 902, 904 can be made of a LYCRA/polyester blend (stretchy) or any other suitable material. The user has option to select and manually place individual bolster supports in desired positions within several inches of each prescribed standard opening, limited by the length of the bolster support's attaching straps 902, 904. FIG. 9 also shows a slot 901 where the towel 210 can pass through the support surface 109 from the back side to the front side of the lounge chair 100.

As noted above, the towel 210 and the neck support bolster can be separate. The towels 210, 211 and spool 212 function can be as described above and can be secured by straps or other retainment structures to the underside of the lounge chair 100

Figure 10:
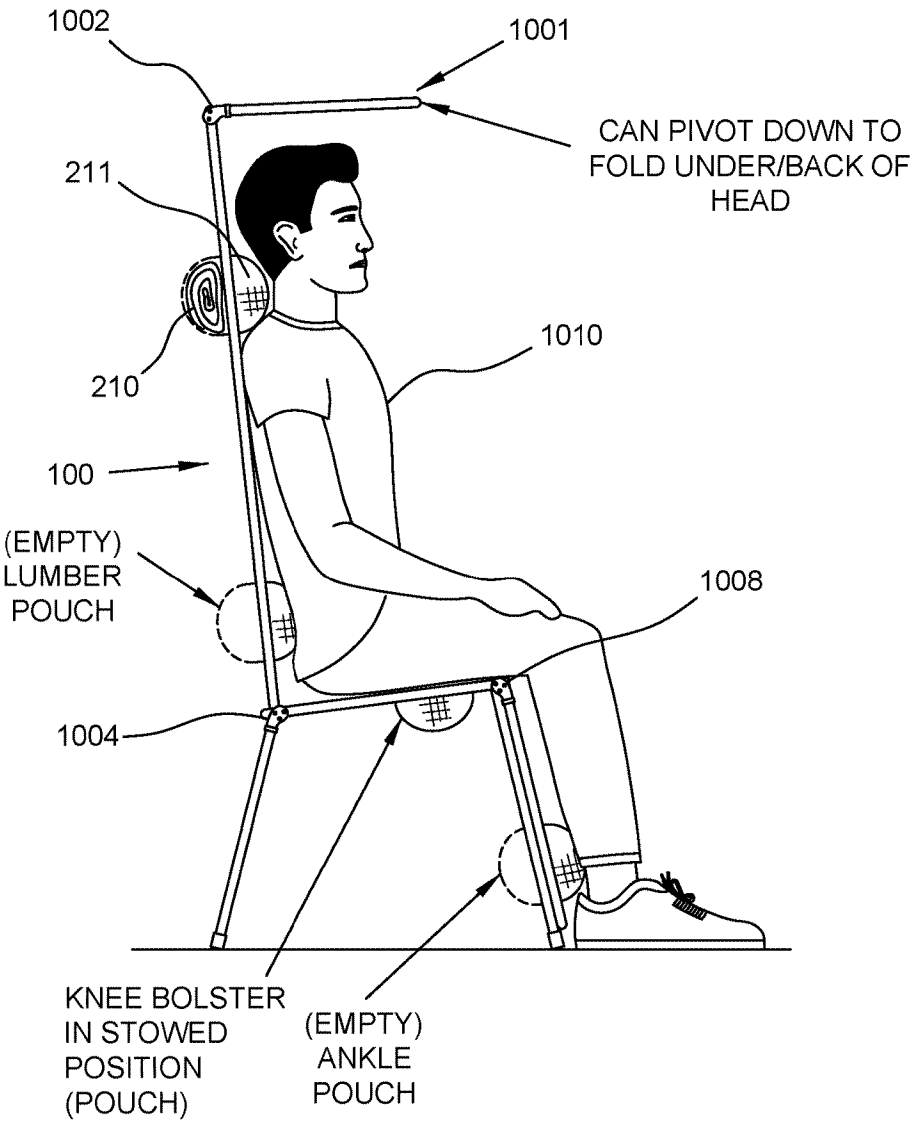
FIG. 10 is an elevational view of an orthopedic lounge chair in an upright chair configuration with deployed back support and leg support bolsters and a seat section bolster stowed in its storage pouch, in accordance with an embodiment of the present invention.

FIG. 10 shows an embodiment of the present invention where the lounge chair 100 has three fold points 1002, 1004, and 1006. Fold point 1002 is approximately 12 inches from the distal most point 1001 of the lounge chair 100, fold point 1004 is approximately 44.5 inches from the distal most point 1001 of the lounge chair 100, and fold point 1006 is approximately 66 inches from the distal most point 1001 of the lounge chair 100.

FIG. 10 depicts a person 1010 in seated position. One of two towels 211 has been pulled through the opening slot in the chair and is rolled up to form a bolster for the person 1010. The other towel 210 remains in the in the rolled position on the spool. The lumbar bolster 204 is deployed/being used and not in its pouch, the knee bolster is stowed in its pouch, and the ankle bolster is deployed/being used.

Disclosed chiropractic lounge chairs 100 can have the option of serving as a standard lounge chair, so that the chiropractic lounge chair can be measured to be constructed with a tall enough base to accommodate the "calf" part of the chair to position vertical (perpendicular to the rest of the chair). This feature allows the owner to extend its use and reap the benefits from a regular seated position. The elevated chiropractic lounge chair has the added benefit for those with back or other orthopedic discomfort of less challenge or discomfort when raising or lowering themselves.

Disclosed orthopedic lounge chairs provide to the user the ability despite a significant chiropractic problem to return to the comfort of relaxing by the pool, at the beach, or in the peace and tranquility of their own backyard. Disclosed bolster supports provide at least the following features:

1. Positioning a user's entire body in a full supported and neutral position.
2. Positioning for comfort, relaxation, and proper spine alignment (reduced pressure on the spine) for the user.
3. Providing beneficial positioning for good posture.
4. Lengthening, stretching, and strengthening muscles in the back of the user.
5. Support the neck of the user in both supine and prone positions. Supine position-laying with a towel as a pillow/bolster under the user's neck puts their shoulders in a neutral position. Prone position-pillow under the chest keeps neck raised avoids a severe neck twist.
6. Disclosed bolster supports can be used for addressing the needs of larger breast women helping to alleviate direct pressure on breasts in prone position and lumbar offers the back support in the supine position.
7. Encouraging natural spine curvature (without spine accentuation)
8. Relieving pain from disc pressure associated with degenerative spine problems.

9. Reducing the pressure on the spaces between discs when support is placed under the abdomen in prone position.
10. Helping to avoid vertebra slips by creating an angle between thigh and trunk of body.
11. Taking the pressure off calves and knees.
12. Addressing issues related to Plantar Fasciitis when using the ankle bolster.
13. Allowing pregnant women more options for comfortable, doctor-approved reclining positions.
14. Benefiting other general health conditions such as asthma, cancer, emphysema, Myofascial Pain Syndrome, even everyday sinus and heartburn problems.

While various disclosed embodiments have been described above, it should be understood that they have been presented by way of example only, and not limitation. Numerous changes to the subject matter disclosed herein can be made in accordance with this disclosure without departing from the spirit or scope of this disclosure. In addition, while a particular feature may have been disclosed with respect to only one of several implementations, such feature may be combined with one or more other features of the other implementations as may be desired and advantageous for any given or particular application.

The claims appended hereto are meant to cover all modifications and changes within the scope and spirit of the present invention.

What is claimed is:

1. An orthopedic lounge chair comprising:
a substantially flat support surface having a length, a width, a front side, and a back side and defining:
a back support section;
a seat section foldably joined to the back support section at a first fold junction; and
a leg support section foldably joined to the seat section at a second fold junction;
a first bolster support coupled to and rising away from the front side of the back support section, the first bolster support extending longitudinally at least a majority of the width of the support surface;
a second bolster support coupled to and rising away from the front side of the seat section, the second bolster support extending longitudinally at least a majority of the width of the support surface;
a third bolster support coupled to and rising away from the front side of the leg support section, the third bolster support extending longitudinally a majority of the width of the support surface,
wherein the first bolster support, the second bolster support, and the third bolster support are not located on the first fold junction or the second fold junction of the lounge chair; and
at least one bolster storage pocket located on the back side of the substantially flat support surface, the at least one bolster storage pocket being accessible from the front side of the substantially flat support surface, through an aperture in the substantially flat support surface.

2. The orthopedic lounge chair according to claim 1, wherein:
the first bolster support, the second bolster support, and the third bolster support rise above the substantially flat support surface at least 2.5 inches.

3. The orthopedic lounge chair according to claim 1, wherein:
the first bolster support is located on the support surface in an area where a user's neck would be when the user is in the orthopedic lounge chair;
the second bolster support is located on the support surface in an area where the user's knee would be when the user is in the orthopedic lounge chair; and
the third bolster support is located on the support surface in an area where the user's ankle would be when the user is in the orthopedic lounge chair.

4. The orthopedic lounge chair according to claim 1, wherein:
the first bolster support, the second bolster support, and the third bolster support each have a firmness that prevents a compression of more than 50% when a human body is supported on the support surface.

5. The orthopedic lounge chair according to claim 1, further comprising:
a towel spool disposed on the back side of the support surface.

6. The orthopedic lounge chair according to claim 5, further comprising:
a first towel disposed on the towel spool, the first towel being retractable and extendable on the towel spool and long enough to cover at least a majority of the length of the front side of the support surface.

7. The orthopedic lounge chair according to claim 6, further comprising:
a second towel disposed on the towel spool, the second towel being retractable and extendable on the towel spool and of sufficient size to serve as a bolster when rolled onto itself.

8. The orthopedic lounge chair according to claim 1, further comprising:
a frame defining and supporting the back support section, seat section, and leg support section, the frame having at least two fold portions, where a first portion of the frame folds onto a second portion of the frame.

9. An orthopedic lounge chair comprising:
a support frame defining:
a back support section having an upper surface and a lower surface;
a seat section having an upper surface and a lower surface; and
a leg support section having an upper surface and a lower surface;
a first bolster support disposed on the upper surface of the back support section;
a second bolster support disposed on the upper surface of the seat section;
a third bolster support disposed on the upper surface of the leg support section; and
a bolster storage pocket located on the lower surface of the back support section, the bolster storage pocket being accessible from the front side of the back support section, through an aperture in the back support section.

10. The orthopedic lounge chair according to claim 9, wherein:
the seat section is foldably joined to the back support section and the leg support section.

11. The orthopedic lounge chair according to claim 9, wherein:
the support frame supports a support surface sized and shaped to support a human body;
the first bolster support and the support surface provide an upward support force in an area where a user's neck would be when the user is lying on the support surface;
the second bolster support and the support surface provide an upward support force in an area where the user's knee would be when the user is lying on the support surface; and the third bolster support and the support surface provide an upward support force in an area where the user's ankle would be when the user is lying on the support surface.

12. The orthopedic lounge chair according to claim 9, further comprising:

a towel spool disposed on a backside of the support frame.

13. The orthopedic lounge chair according to claim 12, further comprising:

a first towel disposed on the towel spool, the first towel being retractable and extendable on the towel spool and long enough to cover at least a majority of a length of a top side of the support frame.

14. The orthopedic lounge chair according to claim 13, further comprising:

a second towel disposed on the towel spool, the second towel being retractable and extendable on the towel spool and of sufficient size to serve as a bolster when rolled onto itself.

15. The orthopedic lounge chair according to claim 9, wherein:

at least two support legs are foldably coupled to the frame.

16. The orthopedic lounge chair according to claim 9, wherein:

the first bolster support rises above the upper surface of the back support section at least 2.5 inches;

the second bolster support rises above the upper surface of the seat section at least 2.5 inches; and the third bolster support rises above the upper surface of the leg support section at least 2.5 inches.

17. An orthopedic lounge chair comprising:

a substantially flat support surface defining:

a back support section with a front side and a back side;

a seat section with a front side and a back side and foldably joined to the back support section at a first fold junction; and a leg support section with a front side and a back side and foldably joined to the seat section at a second fold junction;

a first bolster support coupled to the front side of the back support section and positioned to provide an upward support force to a user laying on the support surface in the area of the user's lumbar;

a second bolster support coupled to the front side of the leg support section and positioned to provide an upward support force to a user laying on the support surface in the area of the user's knee;

a third bolster support coupled to the front side of the leg support section and positioned to provide an upward support force to a user laying on the support surface in the area of the user's ankle;

a first bolster storage pocket located on the back side of the back support section, the first bolster storage pocket being accessible from the front side of the back support section, through an aperture in the back support section; and a second bolster storage pocket located on the back side of the seat section, the second bolster storage pocket being accessible from the front side of the seat section, through an aperture in the seat section.

* * * * *